US005413071A

United States Patent [19]

Paul et al.

[11] Patent Number: 5,413,071

[45] Date of Patent: May 9, 1995

[54] VALVE ACTUATING MECHANISM FOR AN INTERNAL COMBUSTION ENGINE

[75] Inventors: Michael Paul, Bad Friedrichshall; Klaus Fuoss; Wilhelm Hannibal, both of Neckarsulm, all of Germany

[73] Assignee: Audi AG, Ingolstadt, Germany

[21] Appl. No.: 242,363

[22] Filed: May 13, 1994

[30] Foreign Application Priority Data

May 19, 1993 [DE] Germany ..... 43 16 860.4

[51] Int. Cl.[6] ..... F01L 1/12; F01L 1/18; F01L 1/26

[52] U.S. Cl. ..... 123/90.16; 123/90.22; 123/90.4

[58] Field of Search ..... 123/90.15, 90.16, 90.17, 123/90.22, 90.39, 90.4, 90.41, 90.44

[56] References Cited

U.S. PATENT DOCUMENTS

| | | | |
|---|---|---|---|
| 5,046,462 | 9/1991 | Matayoshi et al. | 123/90.16 |
| 5,203,289 | 4/1993 | Hara et al. | 123/90.16 |
| 5,251,586 | 10/1993 | Koga et al. | 123/90.16 |
| 5,297,505 | 3/1994 | Doll et al. | 123/90.16 |

*Primary Examiner*—Tony M. Argenbright

*Assistant Examiner*—Weilun Lo

*Attorney, Agent, or Firm*—Lalos & Keegan

[57] ABSTRACT

A valve actuating mechanism is proposed for an internal combustion engine in which at least one intake valve E is actuatable optionally by a low-speed cam 2 or a high-speed cam. The first rocker lever 5 operates in conjunction with the low-speed cam 2 and the valve E, while the second rocker lever 8,9 operates in conjunction with the high-speed cam 7 and can be connected to the first rocker lever by means of a coupling bolt 12 mounted in a bore 10 of the first rocker lever 5 which is aligned with a bore 11 in the second rocker lever 8, 9 when both rocker levers are riding on the base circles of their cams. The coupling bolt 12 is moved into the coupling position against the force of a spring 17. The spring 17 rests on one side on the end of a pipe 20 connected to the coupling bolt 12 and on the other side on an insert 18 introduced into the bore 10, the pipe 20 extending through this insert 18. In order to achieve brief switching periods, the pipe 20 is provided in the vicinity of the reverse side 31 of the coupling bolt 12 with a cross hole 28 through which quick pressure increase and decrease on the reverse side 30 of the coupling bolt 12 is effected.

2 Claims, 2 Drawing Sheets

VALVE ACTUATING MECHANISM FOR AN INTERNAL COMBUSTION ENGINE

BACKGROUND OF THE INVENTION

The invention relates to a valve actuating mechanism for an internal combustion engine.

An essential requirement for reliable low-wear operation of a valve actuating mechanism is that the engagement and disengagement time, that is, the interval from application of pressure on the coupling bolt to engagement of this bolt in the bore of the other rocker lever, be very brief, since the bores in the rocker levers are aligned with each other only if the rocker levers ride on the base circles of their cams. If the coupling bolt has not been introduced into the second bore to the extent desired during the base circle phase, because of the smaller area of application between the coupling bolt and the wall of the second bore, higher surface pressures arise which may result in extensive wear of the coupling bolt, even if the coupling bolt is fully inserted into the bore after a few rotations of the camshaft. Conversely, it is desirable when pressure is released from the coupling bolt for the purpose of disengagement of the two rocker levers for the coupling bolt to be extracted quickly by the spring from the bore in the second rocker lever, that is, again during the base circle phase to the greatest extent possible. The problem in question intensifies with increase in speed, since the base circle phase, that is, the interval during which the two rocker levers ride on the base circles, shortens as the speed of the camshaft increases.

It is the object of the invention to reduce the disengagement time in a generic valve actuating mechanism.

SUMMARY OF THE INVENTION

According to the invention, pressure is applied to the reverse of the coupling bolt, which initially rests on the insert in the bore, by the pressure medium after an extremely short delay, so that the coupling bolt is very quickly inserted fully into the bore in the other rocker lever. It has been found that switching times on the order of a few milliseconds can be achieved by the invention. Conversely, when pressure is relieved the pressure in the space between the reverse side of the coupling bolt and the insert drops very quickly, so that the spring of the coupling bolt can be restored to its disengaged position without delay. This effect can be further intensified if the pipe is inserted through the insert with radial play in such a way that the pressure medium can flow through the annular space between the pipe and the insert into and out of the space between the reverse side of the coupling bolt and the insert.

DESCRIPTION OF THE PREFERRED EMBODIMENT

Figure 1:
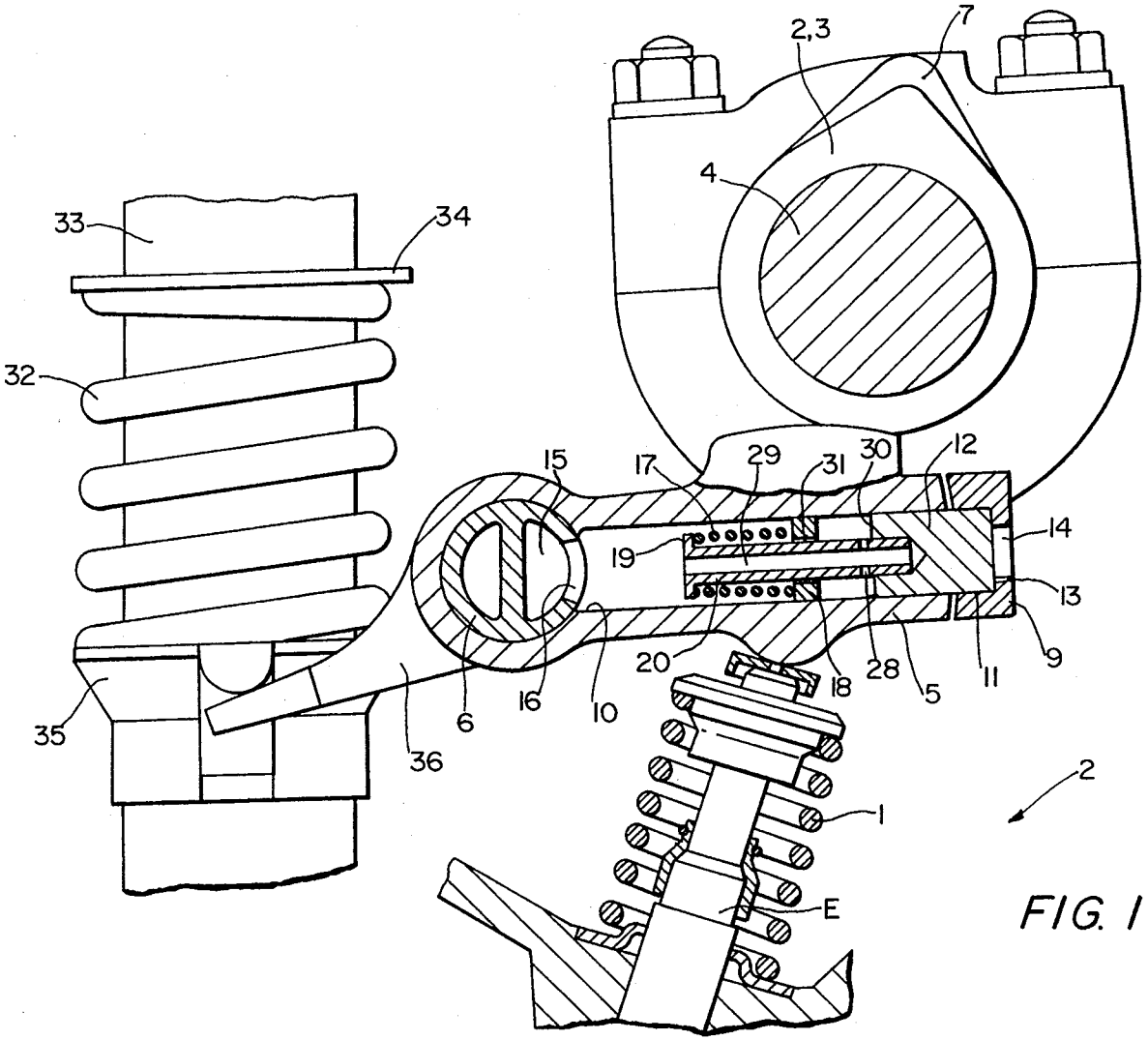
FIG. 1 is a vertical sectional view taken along line 1—1 of FIG. 2 of a valve pinion with a valve actuating mechanism, the coupling bolt being in its engaged position.
Figure 2:
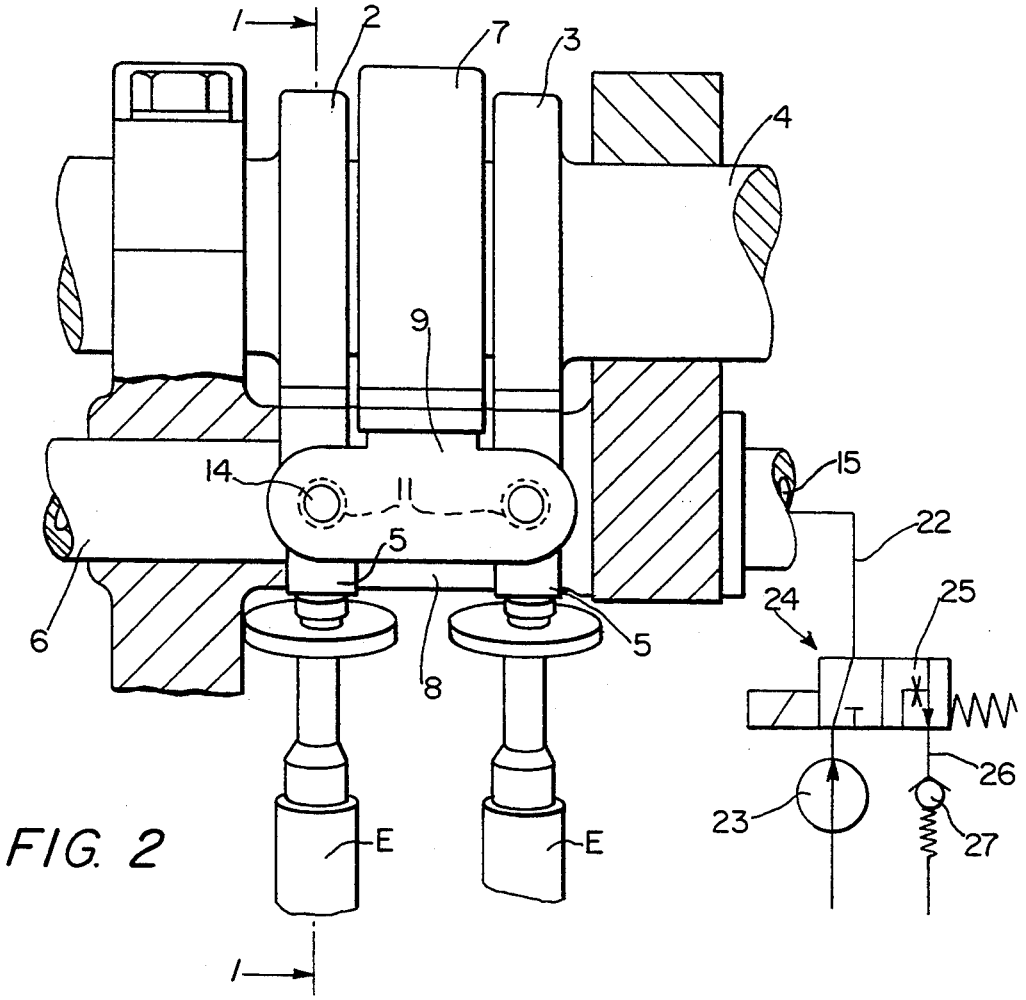
FIG. 2 is a view of the direction of arrow 2 in FIG. 1.
Figure 3:
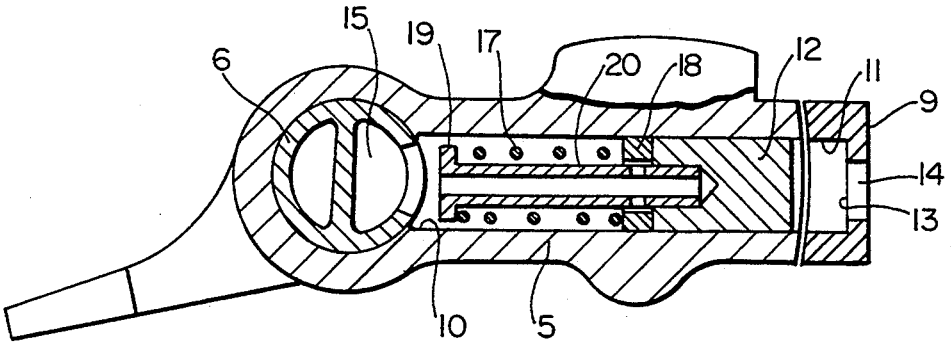
FIG. 3 shows the rocker lever group of FIG. 1, the coupling bolt being in its disengaged position.

Referring to the illustration of the present invention shown in FIGS. 1-3, a valve actuating mechanism for two inlet valves E is shown. A spring 1 applies pressure to each valve E in the direction of closing. The valves are actuated by cams of their own 2,3 of a camshaft 4 by way of first rocker levers 5 rotatably mounted on a common stationary shaft 6. The cams 2 and 3 preferably have different cam profiles so as to achieve a different valve lift, a different open period, and/or different control times for the different intake valves and to create optimum conditions in the lower and medium speed ranges. Mounted on the camshaft 4 between the two cams 2 and 3 is an additional cam 7 whose cam profile is designed for the conditions experienced in the higher speed range, and accordingly effects a greater valve lift and a longer open period. Operating in conjunction with the cam 7 is a second rocker lever 8 which may be coupled with the first rocker levers 5 in the higher speed range, so that in this speed range the valves E are actuated as determined by the profile of the second cam 7. The free end of the second rocker lever 8 is provided with a crosspiece 9 that extends to the front of and a short distance from the free end of the first rocker lever 5. Bores 10 perpendicular to the shaft 6 are provided in the first rocker levers 5 and are aligned with bores 11 in the crosspiece when the valves E are in their closed position, and accordingly the rocker levers 5 and 8 are riding on the base circles of their cams, 2, 3, and 7. Mounted in each bore 10 is a coupling bolt 12 movable between a first inner position (FIG. 3) and a second outer position (FIG. 1) in which it engages the corresponding bore 11 in the crosspiece 9. Hence when in the second position the coupling bolts 12 connect the first rocker levers 5 to the second rocker lever 8, so that the valves are actuated as determined by the profile of the cam 7. In the process each of the coupling bolts rests on a shoulder 13 formed by a vent bore 14 of smaller diameter connected to the bore 11.

The coupling bolts 12 are displaced outward by means of a pressure medium introduced through a duct 15 in the rocker lever shaft 6 communicating with the bores 10 by way of openings 16 in the wall of the shaft 6. When the pressure drops, each of the coupling bolts 12 is returned to its bore 10 by a spring 17 (see FIG. 3), so that the second rocker lever 8 may now swing free and actuation of the valves by the first rocker lever 5 as determined by the profile of the cams 2 and 3 takes place. The spring 17 rests on one side on a insert 18 fixed in bore 10 and on the other side on the end 19 of a pipe 20 fastened to the coupling bolt 12 and extending through the insert 18. The insert 18 simultaneously forms a stop for the coupling bolt 12 when this bolt is in its inner position as shown in FIG. 3.

The duct 15 is connected by a line 22 to a pump 23 that normally is the lubricating oil pump of the internal combustion engine. Mounted in the line 22 is an electromagnetic pilot valve 24 that in the first position illustrated in FIG. 2 connects the line 22 to the pump 23, so that the duct 15 and the bores 10 are placed under high pressure and the coupling bolts 12 are moved to their coupling position shown in FIG. 1. When the pilot valve 24 is in its second position, the line 22 is connected by way of a choke 25 to the pump 23 and simultaneously to a pressure relief line 26 in which is mounted a pressure control valve 27 through which the pressure in the line 22 and accordingly the pressure in the duct 15 and in the bores 10 are reduced to a value at which the springs 17 can return the coupling bolts 12 to their disengaged position illustrated in FIG. 3. In order to achieve the shortest possible switching time, the pipe 20 is provided with at least one cross hole 28 originating in the interior 29 of the pipe 20 and ending near the reverse side 30 of the coupling bolt 12 on the outer surface of the pipe 20. As a result, high pressure is immediately applied to the reverse side 30 of the coupling bolt 12 when the pilot valve 24 is moved to the position shown in FIG. 2. The coupling bolt 12 may thus may be fully introduced into the bore 11 in the crosspiece 9 of the second rocker lever 8 in an extremely short time. Conversely, in the process of disengagement, when the pilot valve 24 is moved to its second position, the pressure in the bore 10 between the insert 18 and the reverse side 30 of the coupling bolt 12 is reduced very quickly through the cross hole, so that the spring 17 can rapidly move the coupling bolt 12 to its position illustrated in FIG. 3. This prevents the coupling bolt from occasionally being only partly seated in the bore 11, a condition which results in increased surface pressure and greater wear. The rise and fall of pressure in the bore 10 beyond the reverse side 30 of the coupling bolt can be further accelerated by extending the pipe 20 through the insert 18 with radial play so that an annular space is formed which connects the sections of the bore 10 on both sides of the insert 18 to each other.

It is also to be noted that the first rocker levers 5 are kept applied to their cams 2 and 3 by the valve springs 1, while a spring 32 is provided for application of the second rocker lever 8 to its cam 7, this spring being mounted on pipe 33 receiving a spark plug or injection valve and resting on one side on a stationary block 34 and on the other on a movable spring guide 35 which operates in conjunction with the extensions 36 of the second rocker lever partly surrounding the pipe 33.

The invention is not limited to the embodiment example presented; it may also be applied for valve actuating devices for internal combustion engines having three intake or exhaust valves or even only one intake or exhaust valve. It is also always possible to provide the coupling device in the second rocker lever as is described in principle in DE-PS [German Patent] 38 00 347.

We claim:

1. A valve actuating mechanism for at least one intake or exhaust valve of an internal combustion engine comprising:

a low-speed actuator including a low-speed cam and a first rocker lever, the first rocker lever being mounted on a rocker lever shaft and including a bore perpendicular to the rocker lever shaft and communicating with a pressure medium duct in the rocker lever shaft, a high-speed actuator including a high-speed cam and a second rocker lever, the second rocker lever including a bore aligned with the first rocker lever bore, a coupling device for connecting the first rocker lever to the second rocker lever, the coupling device including a coupling bolt movably mounted in the first rocker lever bore and adapted to be received within the second rocker lever bore, a means for urging the coupling bolt away from the second rocker lever bore, a means for selectively supplying pressure to the pressure medium duct for moving the coupling bolt between the first rocker lever bore and the second rocker lever bore, a pipe connected to the coupling bolt at one end and including a flange at the other end thereof, and an insert disposed in the first rocker lever bore surrounding the pipe and against which the coupling bolt rests when in the first rocker lever bore, the urging means comprising a spring mounted on the pipe between the pipe flange and the insert, the pipe including at least one cross hole originating in the interior space of the pipe and ending adjacent to a reverse side of the coupling bolt when the coupling bolt is in the second rocker lever bore.

2. A valve actuating mechanism according to claim 1, wherein the pipe extends through the insert with radial play.

* * * * *